US009419390B2

(12) United States Patent
Hou et al.

(10) Patent No.: US 9,419,390 B2
(45) Date of Patent: Aug. 16, 2016

(54) USB ELECTRICAL RECEPTACLE CONNECTOR AND USB ELECTRICAL RECEPTACLE CONNECTOR ASSEMBLY

(71) Applicant: ADVANCED-CONNECTEK INC., New Taipei (TW)

(72) Inventors: Pin-Yuan Hou, New Taipei (TW); Yu-Lun Tsai, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/686,181

(22) Filed: Apr. 14, 2015

(65) Prior Publication Data

US 2015/0303610 A1 Oct. 22, 2015

(30) Foreign Application Priority Data

Apr. 18, 2014 (CN) ..... 2014 1 0154896

(51) Int. Cl.

| | |
|---|---|
| ***H01R 24/00*** | (2011.01) |
| ***H01R 33/00*** | (2006.01) |
| ***H01R 24/62*** | (2011.01) |
| *H01R 12/70* | (2011.01) |
| *H01R 12/72* | (2011.01) |

(52) U.S. Cl.

CPC ..... *H01R 24/62* (2013.01); *H01R 12/7088* (2013.01); *H01R 12/724* (2013.01)

(58) Field of Classification Search

CPC ..... H01R 13/516; H01R 13/22; H01R 24/62; H01R 12/7088; H01R 12/724

USPC ..... 439/660, 79, 83, 80, 607.01, 676

See application file for complete search history.

(56) References Cited

U.S. PATENT DOCUMENTS

2010/0273360 A1* 10/2010 Chen ..... H01R 13/65802 439/676

* cited by examiner

*Primary Examiner* — Javaid Nasri

(74) *Attorney, Agent, or Firm* — Muncy, Geissler, Olds & Lowe, P.C.

(57) ABSTRACT

A USB electrical receptacle connector includes a metal shell, an insulation housing, upper-row terminals, and lower-row terminals. The metal shell defines a receptacle cavity therein for receiving the insulation housing. The insulation housing includes a base portion and a tongue portion extending forward from the base portion. The upper-row and lower-row terminals adjacent to the upper-row terminals are held on the insulation housing. The lower-row terminals include signal terminals and power terminals held on the insulation housing and adjacent to the signal terminals. The power terminals and the signal terminals are aligned at the same level. Each power terminal includes a second body, a second contact portion, a second extending portion, and a second tail portion. Wherein, the width of the second body, the width of the second extending portion, and the width of second tail portion are relatively greater than those of a conventional terminal.

14 Claims, 6 Drawing Sheets

100

USB ELECTRICAL RECEPTACLE CONNECTOR AND USB ELECTRICAL RECEPTACLE CONNECTOR ASSEMBLY

CROSS-REFERENCES TO RELATED APPLICATIONS

This non-provisional application claims priority under 35 U.S.C. §119(a) on Patent Application No. 201410154896.9 filed in China, P.R.C. on 2014 Apr. 18, the entire contents of which are hereby incorporated by reference.

FIELD OF THE INVENTION

The instant disclosure relates to an electrical connector, and more particular to a USB electrical receptacle connector and a USB electrical receptacle connector assembly.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The sizes of existing USB 2.0 and 3.0 electrical connectors and the sizes of their terminals meet the standard formulated by the USB-IF organization. Moreover, in addition to transmitting signals, existing USB 2.0 and 3.0 electrical connectors can be provided for power transmission as well.

With rapid developments in functions of electronic devices, the devices need more electricity for operation, yet the speed for power transmission of the existing USB 2.0 and 3.0 electrical connectors are too slow to allow rapid charging.

In addition, the sizes of the existing USB 2.0 and 3.0 electrical connectors can be further reduced in the premise of retaining the functions of the electrical connectors. Therefore, how to improve the conventional electrical connector becomes an issue and is diligently developed by related personnel.

SUMMARY OF THE INVENTION

In view of this, the instant disclosure provides a USB electrical receptacle connector comprising a metal shell, an insulation housing, a plurality of upper-row terminals, and a plurality of lower-row terminals. The metal shell defines a receptacle cavity therein. The insulation housing is received in the receptacle cavity and comprises a base portion and a tongue portion extending forward from the base portion in the rear-to-front direction. The upper-row terminals are held on the insulation housing. The lower-row terminals are held on the insulation housing and adjacent to the upper-row terminals. The lower-row terminals comprise a plurality of signal terminals and a plurality of power terminals. The signal terminals are held on the insulation housing and each comprise a first body, a first contact portion, a first extending portion, and a first tail portion. For each signal terminal, the first body is fixed to the base portion, the first contact portion is held on the tongue portion, the first extending portion is extending between the first body and the first contact portion, and the first tail portion is extending from the first body. The power terminals are held on the insulation housing and adjacent to the signal terminals. The power terminals and the signal terminals are aligned at the same level. Each of the power terminals comprises a second body, a second contact portion, a second extending portion, and a second tail portion. For each power terminal, the second body is fixed to the base portion, the second contact portion is held on the tongue portion, the second extending portion is extending between the second body and the second contact portion, and the second tail portion is extending from the second body. Wherein, the width of the second body is greater than the width of the first body, the width of the second contact portion is substantially equal to the width of the first contact portion, the width of the second extending portion is greater than the width of the first extending portion, and the width of second tail portion is greater than the width of the first tail portion.

The instant disclosure further provides a USB electrical receptacle connector assembly comprising a USB electrical receptacle connector and a circuit board assembled with the USB electrical receptacle connector. The circuit board comprises a plurality of first-row holes and a plurality of second-row holes. The upper-row terminals are soldered with the first-row holes, and the lower-row terminals are soldered with the second-row holes. The second-row holes comprise a plurality of first signal holes and a plurality of first power holes. The first signal holes are soldered with the first tail portions. The first power holes are soldered with the second tail portions. The size of each of the first power holes is greater than the size of each of the first signal holes. The first power holes are adjacent to the first signal holes, and the first power holes and the first signal holes are aligned with the same level.

Based on the above, because the widths of the second bodies, the second extending portions, and the second tail portions are greater than those of the conventional, the contact areas of the power terminals are increased to improve the speed for power transmission. Therefore, the USB electrical receptacle connector is applicable to electronic products required for high current transmission, and the USB electrical receptacle connector can transmit current with a maximum value equal to or more than 5 amps. Besides, the USB electrical receptacle connector is not only compatible with the USB 3.0 interface, but also compatible with the USB 2.0 interface. In addition, the layout of the holes on the circuit board is configured to reduce the space for installing terminals, such that the rest spaces other than the holes can be applied for installing other components, and the layout of the holes on the circuit board is also configured to prevent from short circuit and capacitive effect which may caused by contacts between solders of first-row holes and second-row holes.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
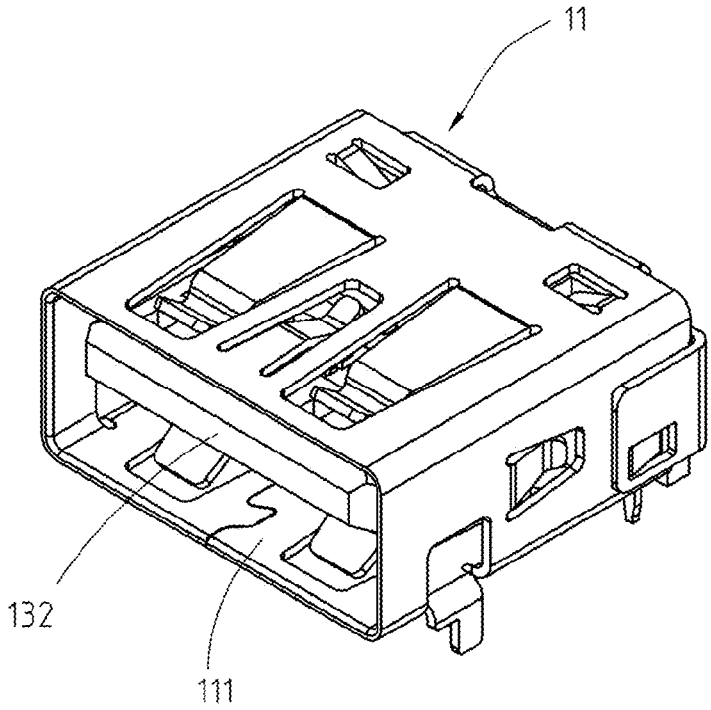
FIG. 1 illustrates a perspective view of a USB electrical receptacle connector formed in an exemplary embodiment according to the instant disclosure.
Figure 2:
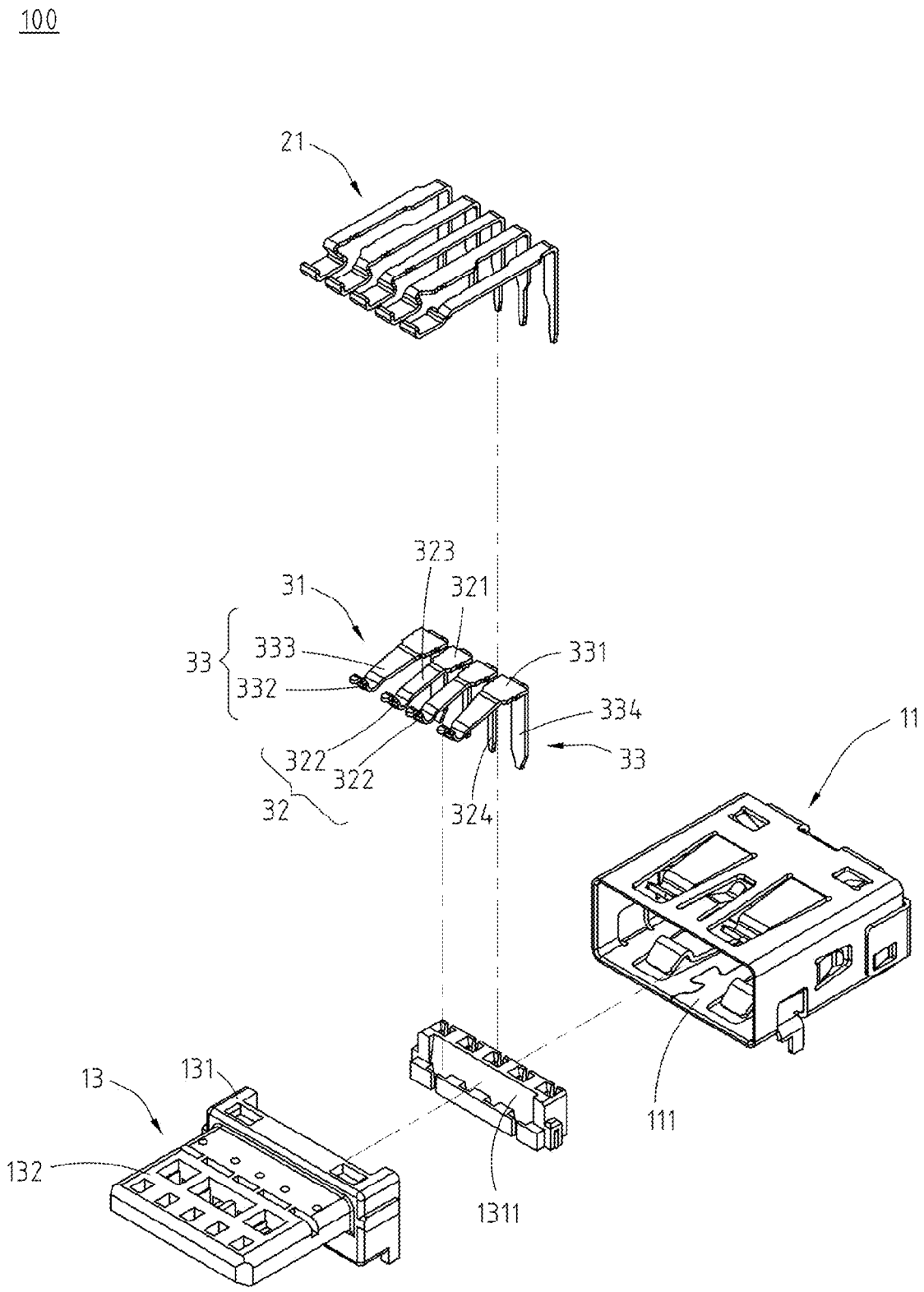
FIG. 2 illustrates an exploded view of the USB electrical receptacle connector formed in an exemplary embodiment according to the instant disclosure.
Figure 3:
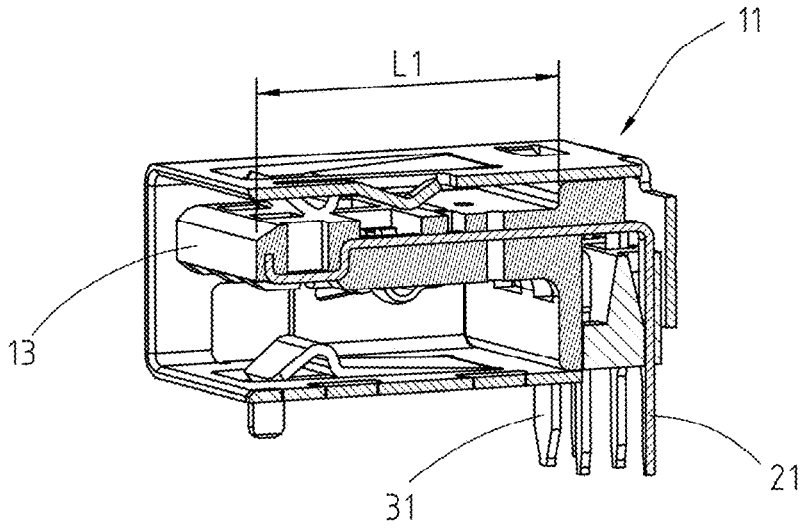
FIG. 3 illustrates perspective sectional view of the USB electrical receptacle connector formed in an exemplary embodiment according to the instant disclosure.

FIG. 1 illustrates a perspective view of a USB electrical receptacle connector 100 formed in an exemplary embodiment. FIG. 2 illustrates an exploded view of the USB electrical receptacle connector 100 formed in an exemplary embodiment. FIG. 3 illustrates perspective sectional view of the USB electrical receptacle connector 100 formed in an exemplary embodiment. Please refer to FIG. 1 to FIG. 3, the USB electrical receptacle connector 100 can provide a USB 3.0 connector interface. The USB electrical receptacle connector 100 comprises a metal shell 11, an insulation housing 13, a plurality of upper-row terminals 21, and a plurality of lower-row terminals 31.

The metal shell 11 defines a receptacle cavity 111 therein. The receptacle cavity 111 is adapted to receive and enclose the insulation housing 13. The metal shell 11 defines an opening at one side thereof. The opening is formed in the shape of rectangular and communicates with the receptacle cavity 111.

The insulation housing 13 is received in the receptacle cavity 111. The insulation housing 13 comprises a base portion 131 and a tongue portion 132. Here, the insulation housing 13 is adapted with several terminal slots for assembling with the upper-row terminals 21 and the lower-row terminals 31, but embodiments are not limited thereto. In some embodiments, the base portion 131 and the tongue portion 132 of the insulation housing 13 may be formed by insert-molding and the upper-row terminals 21 and the lower-row terminals 31 are adapted in the insulation housing 13. In this embodiment, the tongue portion 132 is extending forward from the base portion 131 in the rear-to-front direction. Besides, the base portion 131 is assembled to a terminal mount 1311 adapted to fix the upper-row terminals 21 and the lower-row terminals 31.

The assembly of the upper-row terminals 21 and the lower-row terminals 31 meet the regulation in transmitting USB 3.0 signals. The upper-row terminals 21 are held on the insulation housing 13. The lower-row terminals 31 meet the regulation in transmitting USB 2.0 signals. The lower-row terminals 31 are held on the insulation housing 13 and adjacent to the upper-row terminals 21. The lower-row terminals 31 comprise a plurality of signal terminals 32 and a plurality of power terminals 33.

The signal terminals 32 are held on the insulation housing 13. Each of the signal terminals 32 comprises a first body 321, a first contact portion 322, a first extending portion 323, and a first tail portion 324. The first body 321 is fixed to the base portion 131. The first contact portion 322 is held on the tongue portion 132, and the first contact portion 322 is a flexible piece exposed upon the tongue portion 132. The width of the first contact portion 322 meet the standard formulated by the USB-IF organization. The first extending portion 323 is extending between the first body 321 and the first contact portion 322. The first tail portion 324 is extending from the first body 321, and the first tail portion 324 is a DIP pin.

Figure 5:
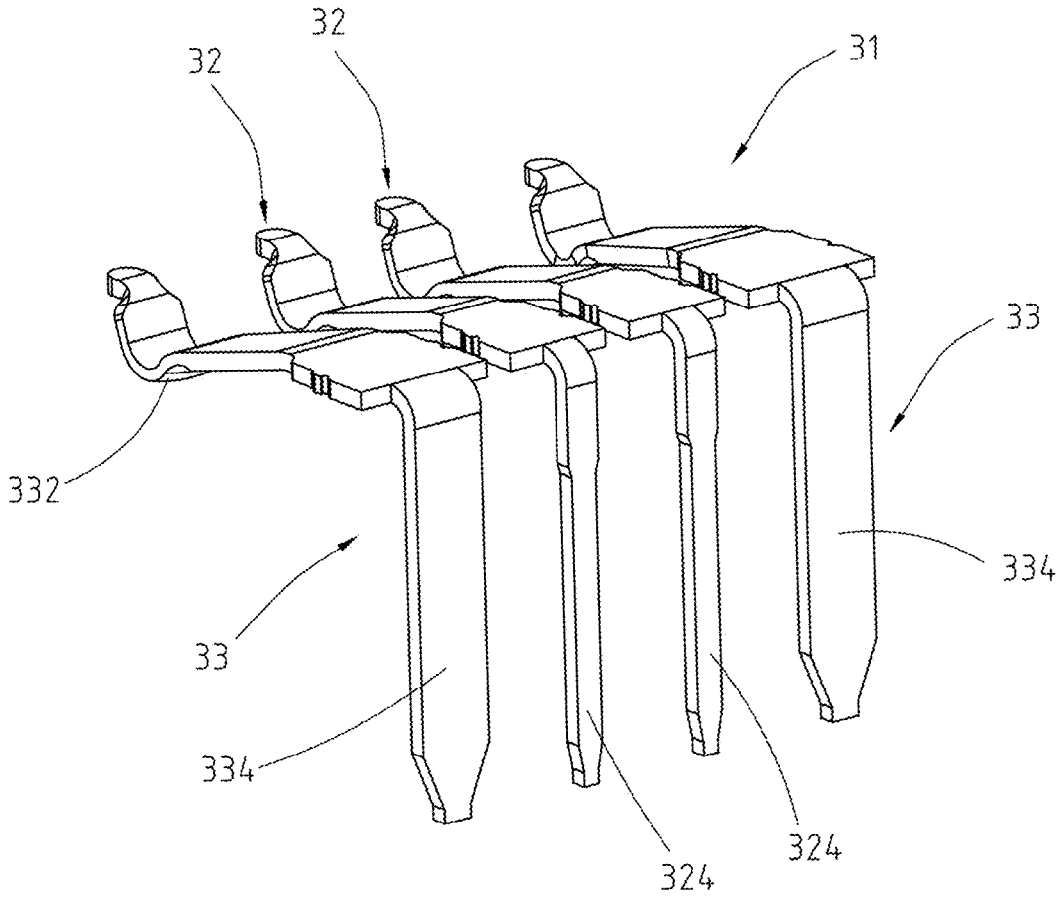
FIG. 5 illustrates a perspective view of the lower-row terminals of the USB electrical receptacle connector according to the instant disclosure.

The power terminals 33 are held on the insulation housing 13. The power terminals 33 are adjacent to the signal terminals 32, and the power terminals 33 and the signal terminals 32 are aligned at the same level. Here, the power terminals 33 are at the two sides of the signal terminals 32; in other words, the signal terminals 32 are sandwiched by the power terminals 33. Here, the signal terminals 32 are a differential pair for signal transmission (D+−), and the power terminals 33 are divided into terminals for power transmission (Power) and terminals for grounded (Gnd). Here, each of the power terminals 33 comprises a second body 331, a second contact portion 332, a second extending portion 333, and a second tail portion 334 (as shown in FIG. 5).

The second body 331 is fixed to the base portion 131, and the width of the second body 331 is greater than the width of the first body 321. Besides, the width of the second body 331 is greater than the width of the second contact portion 332. The second contact portion 332 is held on the tongue portion 132, and the width of the second contact portion 332 is substantially equal to width of the first contact portion 322. Here, the second contact portion 332 is a flexible piece exposed upon the tongue portion 132, and the width of the second contact portion 332 meets the standard formulated by the USB-IF organization. The second extending portion 333 is extending between the second body 331 and the second contact portion 332, and the width of the second extending portion 333 is greater than the width of the first extending portion 323. The second tail portion 334 is extending from the second body 331, the width of the second tail portion 334 is greater than the first tail portion 324, and the second tail portion 334 is a DIP pin. Here, the width of the second body 331 is greater than the width of the first body 321, and the distance between each second body 331 and each corresponding first body 321 may be adjusted to a proper distance to avoid crosstalk interference between terminals during signal or power transmission. Accordingly, when the USB electrical receptacle connector 100 is mated with a USB electrical plug connector, the crosstalk interference within the USB electrical receptacle connector 100 can be attenuated. Moreover, the first and second bodies 321, 332 can pass the terminal strength test, and the first and second bodies 321, 332 have proper volumes.

When the USB electrical receptacle connector 100 is mated with a USB electrical plug connector, because the widths of the second bodies 331, the second extending portions 333, and the second tail portions 334 are greater than those of the conventional, the contact areas of the power terminals 33 are increased so as to improve the speed for power transmission. Therefore, the USB electrical receptacle connector 100 according to the embodiment is applicable to electronic products required for high current transmission. A typical USB 3.0 electrical connector can transmit current with a maximum value of about 1.8 amps, yet a typical USB 2.0 electrical connector can transmit current with a maximum value of about 1.5 amps. The USB electrical receptacle connector 100 for transmitting USB 3.0 signals according to the embodiment can transmit current with a maximum value equal to or more than 5 amps. Besides, the USB electrical receptacle connector 100 is not only compatible with the USB 3.0 interface, but also compatible with the USB 2.0 interface.

Figure 4:
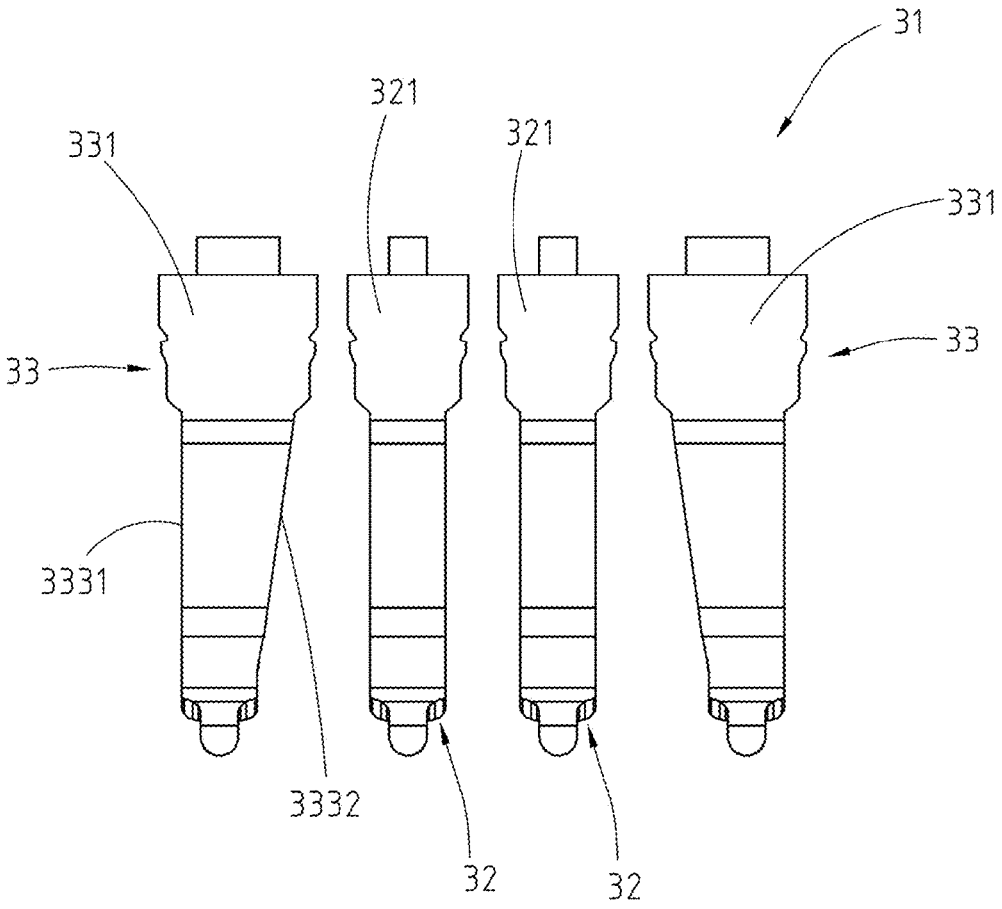
FIG. 4 illustrates a top view of lower-row terminals of the USB electrical receptacle connector according to the instant disclosure.

Please refer to FIG. 4, which illustrates a top view of the lower-row terminals 31. As shown, the second extending portion 333 of each of the power terminals 33 has a first lateral surface 3331 and a second lateral surface 3332. For each power terminal 33, the first lateral surface 3331 is joined between one of two sides of the second contact portion 332 and one of two sides of the second body 331, and the second lateral surface 3332 is joined between the other side of the second contact portion 332 and the other side of the second body 331. For each power terminal 33, the first lateral surface 3331 is not parallel to the second lateral surface 3332. In other words, the first lateral surface is slanted from the second lateral surface 3332. Accordingly, the contact areas of the power terminals 33 are increased so as to improve the speed for power transmission effectively.

Please refer to FIG. 3, in which embodiment, a first distance L1 is defined between the front portion of the tongue portion 132 and the base portion 131. The first distance L1 is 8.85 mm, in other words, the length of the tongue portion 132 of the USB electrical receptacle connector 100 according to the embodiment is 8.85 mm, which is smaller than the length of a tongue portion standardized by the USBIF organization, 10.15 mm. Therefore, when the USB electrical receptacle connector 100 is mated with a USB electrical plug connector, the USB electrical plug connector would be in contact with the base portion 131 inside the metal shell 11 of the USB electrical receptacle connector 100, and the terminals of the USB electrical plug connector are in contact with the upper-row terminals 21 and the lower-row terminals 31 of the USB electrical receptacle connector. Accordingly, the USB electrical receptacle connector 100 is configured to be mated with a conventional USB electrical plug connector, and the USB electrical receptacle connector 100 can perform effective power and signal transmission. That is, in the premise of retaining the USB 3.0 and USB transmission compatibility, the overall size of the USB electrical receptacle connector 100 can be decreased by the shortening of the tongue portion 132. In other words, for a typical USB electrical receptacle connector, the tongue portion is much longer such that the USB electrical plug connector would not be in contact with the base portion inside the metal shell of the typical USB electrical receptacle connector, and the overall size of the typical USB electrical receptacle connector would be greater than the overall size of the USB electrical receptacle connector 100 according to the embodiments.

Figure 6:
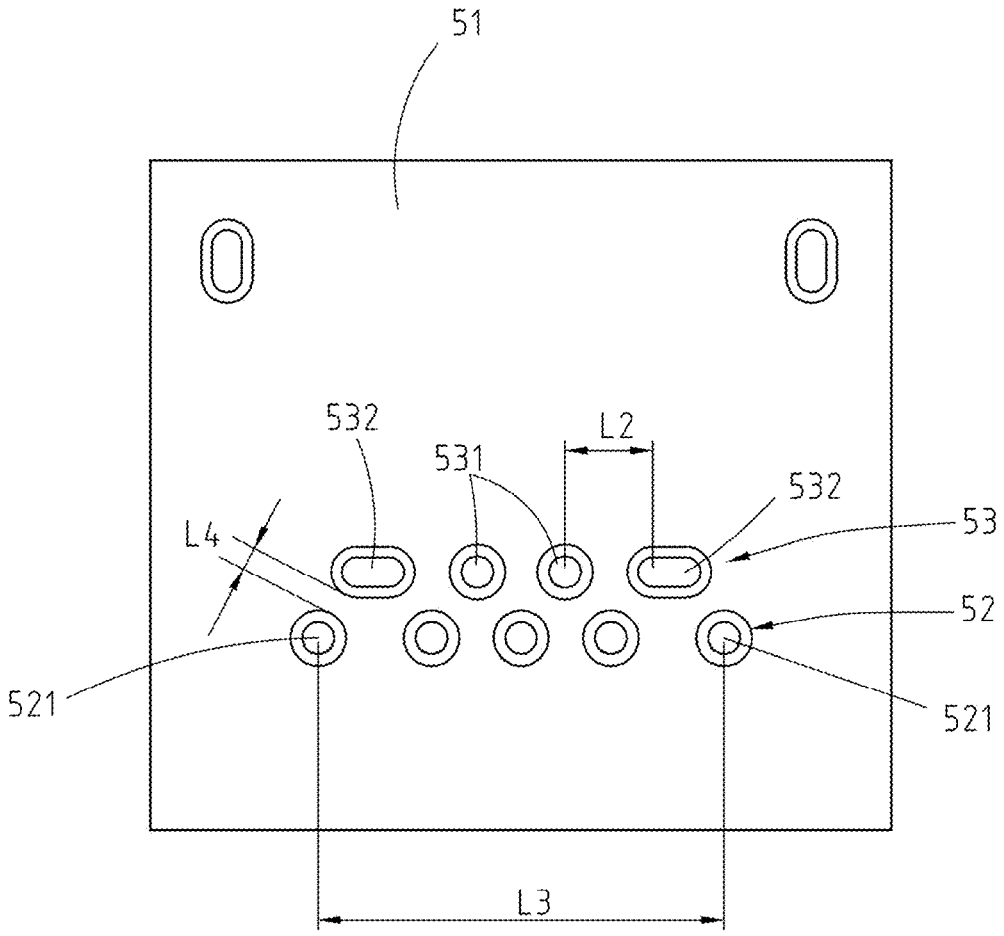
FIG. 6 illustrates a top view of a circuit board of a USB electrical receptacle connector assembly formed in an exemplary embodiment according to the instant disclosure.

Please refer to FIG. 2 and FIG. 6, where FIG. 6 illustrates a top view of a circuit board 51 adapted to be assembled with the USB electrical receptacle connector 100. In some embodiments, the USB electrical receptacle connector 100 is adapted to be combined to the circuit board 51 and formed as a USB electrical receptacle connector assembly. Here, the circuit board 51 is adapted to be assembled with the USB electrical receptacle connector 100 and the circuit board 51 comprises a plurality of first-row holes 52 and a plurality of second-row holes 53. The upper-row terminals 21 of the USB electrical receptacle connector 100 are adapted to be soldered with the first-row holes 52, and the lower-row terminals 31 of the USB electrical receptacle connector 100 are adapted to be soldered with the second-row holes 53. The second-row holes 53 comprise a plurality of first signal holes 531 and a plurality of first power holes 532. Here, the distance between the first-row holes 52 and the second-row holes 53 of the circuit board 51 according to the embodiment is different from the distance between the first-row holes and the second-row holes of a circuit board standardized by the USBIF organization, but embodiments are not limited thereto. In some embodiments, the distance between the first-row holes 52 and the second-row holes 53 of the circuit board 51 may be the same as the distance between the first-row holes and the second-row holes of a circuit board standardized by the USBIF organization.

The first tail portions 324 are adapted to be soldered with the first signal holes 531, and the second tail portions 334 are adapted to be soldered with the first power holes 532. The size of each of the first power holes 532 is greater than the size of each of the first signal holes 531. The first power holes 532 are adjacent to the first signal holes 531, and the first power holes 532 and the first signal holes 531 are aligned with the same level. In other words, the first power holes 532 and the first signal holes 531 are aligned along a horizontal line. Each of the first power holes 532 is approximately formed as an ellipse. Here, the width of the long axis of each of the first power holes 532 is 1.4 mm.

In assembling the USB electrical receptacle connector 100 to the circuit board 51, the first-row holes 52 and the second-row holes 53 of the circuit board 51 are respectively soldered with the upper-row terminals 21 and the lower-row terminals 31 of the USB electrical receptacle connector 100. Since the sizes of the first power holes 532 are mated with the size of the second tail portions 334 and the sizes of the first signal holes 531 are mated with the size of the first tail portions 324, the first tail portions 324 and the second tail portions 334 can be respectively inserted into the first signal holes 531 and the first power holes 532. Accordingly, solders are then applied to the first tail portions 324 and the second tail portions 334 to fix the upper-row terminals 21 and the lower-row terminals 31 with the circuit board 51.

Please refer to FIG. 6, in some embodiments, the distance between two adjacent power holes 532 is 6.5 mm, which is less than 7 mm, the distance between two adjacent power holes of a circuit board standardized by the USBIF organization. Specifically, in some embodiments, a second distance L2 is defined between a proximate center of each of the first power holes 532 and the center of adjacent first signal hole 531. Based on this, the circuit board 51 according to the embodiments can provide more spaces for assembling or installing other components. In addition, the overall volume of USB electrical receptacle connector 100 corresponding to the circuit board 51 can be reduced.

Please refer to FIG. 6, in some embodiments, the first-row holes 52 further comprises a plurality of second outermost holes 521, and a third distance L3 is defined between each two adjacent second outermost holes 521. In addition, a fourth distance L4 is defined between the circumferential edge of each of the second outermost holes 521 and the circumferential edge of adjacent first power hole 532. The third distance L3 is 9 mm, which is greater than 8 mm, the distance between each two adjacent second outermost holes standardized by the USBIF organization. Based on this, the fourth distance L4 can be configured properly. Accordingly, when the upper-row terminals 21 and the lower-row terminals 31 are assembled to the circuit board 51, the solders applied to the second outermost holes 521 are not in contact with the solders applied to the first power holes 532 to prevent short circuit condition and capacitive effect. Moreover, by adjusting the fourth distance L4 properly, the circuit board 51 according to the embodiments can provide more spaces for assembling or installing other components. In addition, the overall volume of USB electrical receptacle connector 100 corresponding to the circuit board 51 can be reduced.

Based on the above, because the widths of the second bodies, the second extending portions, and the second tail portions are greater than those of the conventional, the contact areas of the power terminals are increased to improve the speed for power transmission. Therefore, the USB electrical receptacle connector is applicable to electronic products required for high current transmission, and the USB electrical receptacle connector can transmit current with a maximum value equal to or more than 5 amps. Besides, the USB electrical receptacle connector is not only compatible with the USB 3.0 interface, but also compatible with the USB 2.0 interface. In addition, the layout of the holes on the circuit board is configured to reduce the space for installing terminals, such that the rest spaces other than the holes can be applied for installing other components, and the layout of the holes on the circuit board is also configured to prevent from short circuit and capacitive effect which may caused by contacts between solders of first-row holes and second-row holes.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A USB electrical receptacle connector, comprising:

a metal shell, defining a receptacle cavity therein;

an insulation housing, received in the receptacle cavity, the insulation housing comprising a base portion and a tongue portion extending forward from the base portion in the rear-to-front direction;

a plurality of upper-row terminals, held on the insulation housing; and a plurality of lower-row terminals, held on the insulation housing, wherein the lower-row terminals are adjacent to the upper-row terminals, and wherein the lower-row terminals comprise:

a plurality of signal terminals, held on the insulation housing, wherein each of the signal terminals comprises:

a first body, fixed to the base portion;

a first contact portion, held on the tongue portion;

a first extending portion, extending between the first body and the first contact portion; and a first tail portion, extending from the first body; and a plurality of power terminals, held on the insulation housing, wherein the power terminals are adjacent to the signal terminals, and the power terminals and the signal terminals are aligned at a same level, and wherein each of the power terminals comprises:

a second body, fixed to the base portion, wherein a width of the second body is greater than a width of the first body;

a second contact portion, held on the tongue portion, wherein a width of the second contact portion is equal to a width of the first contact portion;

a second extending portion, extending between the second body and the second contact portion, wherein a width of the second extending portion is greater than a width of the first extending portion; and a second tail portion, extending from the second body, wherein a width of the second tail portion is greater than a width of the first tail portion.

2. The USB electrical receptacle connector according to claim 1, wherein the width of the second body is greater than the width of the second contact portion.

3. A USB electrical receptacle connector assembly, comprising:

the USB electrical receptacle connector according to claim 2; and a circuit board, assembled with the USB electrical receptacle connector, wherein the circuit board comprises a plurality of first-row holes and a plurality of second-row holes, the upper-row terminals are soldered with the first-row holes, the lower-row terminals are soldered with the second-row holes, wherein the second-row holes comprise:

a plurality of first signal holes, soldered with the first tail portions; and a plurality of first power holes, soldered with the second tail portions, wherein the size of each of the first power holes is greater than the size of each of the first signal holes, the first power holes are adjacent to the first signal holes, and the first power holes and the first signal holes are aligned with the same level.

4. The USB electrical receptacle connector according to claim 1, wherein each of the second extending portions has a first lateral surface and a second lateral surface, the first lateral surface of each second extending portion is joined between one of two sides of the corresponding second contact portion and one of two sides of the corresponding second body, and the second lateral surface of each second extending portion is joined between the other side of the corresponding second contact portion and the other side of the corresponding second body, the first lateral surface is not parallel to the second lateral surface.

5. A USB electrical receptacle connector assembly, comprising:

the USB electrical receptacle connector according to claim 4; and a circuit board, assembled with the USB electrical receptacle connector, wherein the circuit board comprises a plurality of first-row holes and a plurality of second-row holes, the upper-row terminals are soldered with the first-row holes, the lower-row terminals are soldered with the second-row holes, wherein the second-row holes comprise:

a plurality of first signal holes, soldered with the first tail portions; and a plurality of first power holes, soldered with the second tail portions, wherein the size of each of the first power holes is greater than the size of each of the first signal holes, the first power holes are adjacent to the first signal holes, and the first power holes and the first signal holes are aligned with the same level.

6. The USB electrical receptacle connector according to claim 1, wherein a first distance is defined between a front portion of the tongue portion and the base portion.

7. A USB electrical receptacle connector assembly, comprising:

the USB electrical receptacle connector according to claim 6; and a circuit board, assembled with the USB electrical receptacle connector, wherein the circuit board comprises a plurality of first-row holes and a plurality of second-row holes, the upper-row terminals are soldered with the first-row holes, the lower-row terminals are soldered with the second-row holes, wherein the second-row holes comprise:

a plurality of first signal holes, soldered with the first tail portions; and a plurality of first power holes, soldered with the second tail portions, wherein the size of each of the first power holes is greater than the size of each of the first signal holes, the first power holes are adjacent to the first signal holes, and the first power holes and the first signal holes are aligned with the same level.

8. A USB electrical receptacle connector assembly, comprising:

a USB electrical receptacle connector according to claim 1; and a circuit board, assembled with the USB electrical receptacle connector, wherein the circuit board comprises a plurality of first-row holes and a plurality of second-row holes, the upper-row terminals are soldered with the first-row holes, the lower-row terminals are soldered with the second-row holes, wherein the second-row holes comprise:

a plurality of first signal holes, soldered with the first tail portions; and a plurality of first power holes, soldered with the second tail portions, wherein the size of each of the first power holes is greater than the size of each of the first signal holes, the first power holes are adjacent to the first signal holes, and the first power holes and the first signal holes are aligned with the same level.

9. The USB electrical receptacle connector assembly according to claim 8, wherein a second distance is defined between each of the first power holes and adjacent first signal hole.

10. The USB electrical receptacle connector assembly according to claim 8, wherein the first-row holes comprise a plurality of second outermost holes, a third distance is defined between each two adjacent second outermost holes.

11. The USB electrical receptacle connector assembly according to claim 10, wherein a fourth distance is defined between the circumferential edge of each of the second outermost holes and the circumferential edge of adjacent first power hole.

12. The USB electrical receptacle connector assembly according to claim 8, wherein the width of the second body is greater than the width of the second contact portion.

13. The USB electrical receptacle connector assembly according to claim 8, wherein each of the second extending portions has a first lateral surface and a second lateral surface, the first lateral surface of each second extending portion is joined between one of two sides of the corresponding second contact portion and one of two sides of the corresponding second body, and the second lateral surface of each second extending portion is joined between the other side of the corresponding second contact portion and the other side of the corresponding second body, the first lateral surface is not parallel to the second lateral surface.

14. The USB electrical receptacle connector assembly according to claim 8, wherein a first distance is defined between the front portion of the tongue portion and the base portion.

* * * * *